US006097826A

United States Patent [19]

Clavadetscher et al.

[11] Patent Number: 6,097,826

[45] Date of Patent: Aug. 1, 2000

[54] HEARING AID TO BE CARRIED COMPLETELY IN THE AUDITORY CANAL AND INDIVIDUALIZED BY A CAST BODY

[75] Inventors: Jürg Clavadetscher, Ortschwaben; Marcel Aeschilmann, Biel, both of Switzerland

[73] Assignee: Bernafon AG, Bern, Switzerland

[21] Appl. No.: 08/899,416

[22] Filed: Jul. 23, 1997

[30] Foreign Application Priority Data

Jul. 24, 1996 [CH] Switzerland ..... 1860/96

[51] Int. Cl.[7] ..... H04R 25/00

[52] U.S. Cl. ..... 381/324; 381/322; 381/328; 381/329

[58] Field of Search ..... 381/322, 354, 381/325, 329, 330, 380; 181/129, 130, 135, 132

[56] References Cited

U.S. PATENT DOCUMENTS 4,735,759 4/1988 Bellafiore ..... 381/322
4,739,512 4/1988 Hartl et al. ..... 381/324
4,834,927 5/1989 Birkholz et al. ..... 381/322
4,880,076 11/1989 Ahlberg et al. ..... 381/322
4,962,537 10/1990 Basel et al. ..... 381/324
5,530,763 6/1996 Aebi et al. ..... 381/322

*Primary Examiner*—Cutris A. Kuntz
*Assistant Examiner*—Rexford N. Barnie
*Attorney, Agent, or Firm*—Milton Oliver; Ware, Fressola, Van Der Sluys & Adolphson LLP

[57] ABSTRACT

A hearing aid to be worn completely in the auditory canal and is adaptable to an individual auditory canal, is individualized by casting of a body in an auditory canal or in a model of an auditory canal. The body is cast in a casting cavity (15) at least partly confined by an extensible membrane (14). In its general condition, before or especially during casting, the inventive hearing aid carries a positioning tip (20) which surrounds the innermost part of the hearing aid radially completely. This positioning tip (20) which is designed to have the form of a tube or of a cap serves for centering the innermost part of the hearing aid when it is introduced into the auditory canal or into the model of such a canal for individualization. After the casting of the body the positioning tip (20) is removed. The innermost part of the individualized appliance, after removal of the positioning tip, is orientated relative to the body of the appliance such that it does not touch the wall of the auditory canal when the hearing aid is worn.

11 Claims, 2 Drawing Sheets

HEARING AID TO BE CARRIED COMPLETELY IN THE AUDITORY CANAL AND INDIVIDUALIZED BY A CAST BODY

FIELD OF THE INVENTION

The invention is in the field of hearing aids and concerns a hearing aid to be carried completely in the auditory canal.

BACKGROUND OF THE INVENTION

Hearing aids to be carried in the auditory canal, so called CIC-appliances (CIC for "Completely In the Canal"), comprise like other hearing aids substantially the following components serving the hearing function: a microphone directed toward the outside of the auditory canal for reception of sound from the outside world and for transformation of this sound into electric signals, an amplifier for amplification of these electric signals, a loudspeaker facing the inside of the auditory canal for transformation of the amplified electric signals into sound and a power source (battery) for operation of the named components. The amplifier is normally designed as an integrated circuit (chip) and, in addition to the amplifying functions, it may have control functions and/or may be programmable. The hearing aid may further comprise a receiving coil for reception of signals for remote control of the appliance or for reception of radio or telephone signals. The hearing aid can also be designed for the reception of radio signals only and thus only comprise a receiving coil and no microphone.

Furthermore, a CIC-hearing-aid needs supporting elements like any other hearing aid and is advantageously adapted in its form to the auditory canal of the individual person carrying it as precisely as possible.

ITC- and CIC-hearing-aids which are adapted to an individual auditory canal, by casting a body using the auditory canal or a model of it as a mold, are e.g. described in the publication EP-629101 and in a parallel application to the present application (U.S. application Ser. No. 08/899,415). In their general condition, i.e. in the condition not yet adapted to an individual auditory canal the appliances comprise a casting cavity substantially confined by an extensible membrane which cavity, for individualizing the appliance, is filled with a casting material through a pouring opening in the region of the outer face. The hearing aid has the form of an irregular frustum or cylinder with an outer face and an inner face and a circumferential surface, wherein the outer face is formed by a face plate, the inner face substantially by the outlet side of the loudspeaker and the circumferential surface by the body being covered by the membrane and adapted to the auditory canal.

The main difference of a CIC-hearing-aid compared to other hearing aids is the fact that it reaches much deeper into the auditory canal when worn. This position, deep in the auditory canal, has two main advantages one of which is an acoustic one, the other one an aesthetic one. The acoustic advantage is the fact that the space between the eardrum and the inner end of the hearing aid is smaller which improves the quality of sound and reduces the necessary amplification, i.e. the energy necessary for operation. The aesthetic advantage is the fact that the appliance is less visible. A difficulty which arises from the position deep in the auditory canal is constituted by the fact that the appliance reaches as far as the bony part of the auditory canal which bony part is extremely sensitive to contact.

Therefore, it is desirable for the comfort of the wearer for the CIC-hearing-aid to be adapted to the individual auditory canal as precisely as possible and at the same time for its innermost part to have as little contact as possible with the wall of the auditory canal.

SUMMARY OF THE INVENTION

It is an object of the invention to create a CIC-hearing-aid which is individualized by casting a body in an individual auditory canal and which, in its individualized condition comprises an innermost part which is not only axially spaced from the eardrum but also radially spaced around its circumference from the wall of the auditory canal. The individualizing process is simple to be carried out, the cast body in particular does not require any further processing.

In its general condition, i.e. before the casting of the body, the inventive hearing aid comprises a positioning tip in the area of its inner face which positioning tip surrounds the innermost part of the appliance radially and possibly protrudes from it axially. The positioning tip substantially has the form of a tube and is made from a material inoffensive to skin.

When the hearing aid, in its general condition in which it has no body adapted to the auditory canal, is inserted into the auditory canal for the casting of the body the positioning tip takes care that the innermost part of the hearing aid is substantially centered in the auditory canal and possibly also that the body to be cast does not extend up to the wall of the auditory canal in this region. After casting the body, the positioning tip is removed from the hearing aid.

In the individualized hearing aid, the body being adapted to the auditory canal, ensures a precisely defined position in the auditory canal which substantially corresponds to the position of the general hearing aid. In particular, the innermost part of the appliance has the same position, in which a distance between auditory canal and appliance is maintained due to the removal of the positioning tip.

Furthermore, a part of the positioning tip which protrudes over the innermost part of the hearing aid may serve as a tampon, i.e. as a means for preventing the general appliance from coming too near to the eardrum. For this function it is advantageous to manufacture the part of the positioning tip which protrudes axially over the innermost part of the appliance or at least part of it from a softer material, e.g. from a foamed plastic or from cotton wool.

The positioning tip is e.g. fastened removably with a suitable positive engaging means to the hearing aid in the region of its inner face. It can also be fastened to the appliance by means of a part of a provisional supporting element protruding over the inner face of a hearing aid. After casting of the body, the positioning tip is removed and possibly replaced by a protecting over for the outlet of the loudspeaker.

BRIEF DESCRIPTION OF THE DRAWINGS

Embodiments of the inventive hearing aid are described in detail in connection with the following Figures, whereby.

DETAILED DESCRIPTION OF PREFERRED EMBODIMENTS

Figure 1:
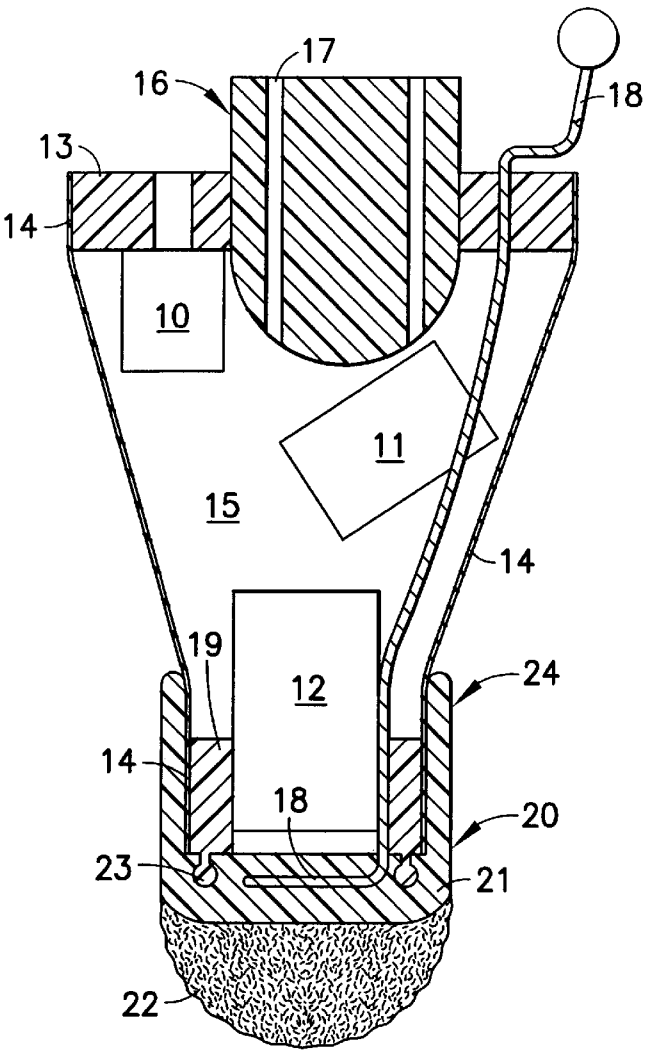
FIG. 1 is a schematic sectional view, parallel with the axis, of an embodiment of the inventive hearing aid in its general condition.

FIG. 1 shows an example of an inventive CIC-hearing-aid as a diagrammatic section which hearing aid is individualized by the casting of a body.

The hearing aid is shown in its general condition, i.e. it has no body adapted to an individualized auditory canal yet The appliance itself, apart from the positioning tip which is fitted to the appliance in the region of the inner face, is described in detail in the parallel application previously mentioned such that a detailed description can be omitted here.

The hearing aid e.g. comprises a microphone 10, an amplifier/chip 11 and a loudspeaker 12 as elements serving the hearing function. The appliance further comprises a face plate 13 with a battery opening, wherein the face plate 13 substantially constitutes the outer face of the appliance and the outlet side of the loudspeaker 12 substantially constitutes the inner face of the appliance. An extensible membrane 14 substantially having the form of a tube reaches from the outer face to the inner face of the appliance. The membrane 14 confines a casting cavity 15 which for individualization is filled with a casting material e.g. through a pouring opening 17 in a casting template 16. The casting template 16 is positioned in the battery opening of the face plate 13 and is primarily designed for forming a battery rack between the body to be cast and the face plate. Furthermore, the general hearing aid comprises a provisional supporting element 18 which protrudes from the appliance on the outer and the inner face and which is removed from the appliance after casting. In order for the loudspeaker 12 to have a defined position relative to the face plate 13 a connecting means 19 is provided in the region of the inner face.

The provisional supporting element in the hearing aid has in its general condition a supporting function and the function of positioning the elements relative to each other. Furthermore, it limits the axial length of the appliance such that, on casting, the appliance does not become longer. An increase in length would risk the possibility of the inner end of the hearing aid coming into contact with the ear drum. The length-limiting function is the most important one and that for many cases the supporting and positioning function is not necessary. In such cases instead of a provisional supporting element, a flexible length-limiting element is provided, e.g. a sort of string extending within a flexible tube from the face plate to the inner face and serving as a mold for a ventilation channel in the same way as the provisional supporting element. The flexible length-limiting element as well as the provisional supporting element is removed after casting of the body.

Further embodiments of the inventive hearing aid are also possible in which, instead of a face plate with a battery opening and a casting template closing the battery opening, comprise a face plate with a depression in form of a battery rack. This battery rack comprises a pouring opening and possibly a ventilation opening, whereby a tube can be connected to the pouring opening which tube reaches as far towards the inner face of the hearing aid as possible and which tube guarantees that the body is cast starting in the area of the inner face and progressing towards the outer face.

In contrast to the general bearing aid according to the mentioned parallel application, the inventive hearing aid comprises in its general condition, i.e. before the casting of the body and in particular when casting the body, in the region of its inner face, a positioning tip 20 which is e.g. shown in FIG. 1 as a cap 21 with a tampon 22 formed onto it. The positioning tip 20 surrounds the innermost part of the hearing aid radially and has a diameter which is smaller than the inner diameter of the inner part of a normal auditory canal. When introducing the general appliance into the auditory canal the positioning tip will most probably touch the wall of the auditory canal. However, as this step is carried out by a specialist and only once the discomfort will be within tolerable limits.

The positioning tip 20 of the hearing aid according to FIG. 1 is fitted, in the region of the inner face of the appliance, on the one hand to the provisional supporting element 18 or to a corresponding flexible length-limiting element. The one end of the provisional supporting element which protrudes over the inner face is e.g. cast into the positioning tip 20 or the length-limiting element is an appendix of the positioning top. On the other hand, positive engaging means 23 are provided on the inner face side of the connecting means 19 and/or on the positioning tip with which positive engaging means 23 the positioning tip is fixed to the connecting means 19. FIG. 1 shows an example of a positive engaging means 23 in form of a groove and a corresponding tongue. The positive engaging means can also be designed as a snap connection of a different kind.

The positioning tip 20 of the hearing aid according to FIG. 1 protrudes over the connecting means 19 in an axial direction, not only in the direction of the eardrum but also in the opposite direction (towards face plate 13). This means that in a region 24 it takes over the function of the casting mold and prevents in this region, radial expansion of the membrane 14 as far as the wall of the auditory canal.

The positioning tip 20 consists e.g. of a thermoplastic elastomer or of a polyurethane and is advantageously produced by injection molding. Using a multi-material injection molding method it is not only possible to cast around a provisional supporting element in form of a metal wire but it is possible also to cast two materials being different from each other to a limited degree such that the two materials are connected to each other, e.g. a foamed material for the tampon 22 and a not foamed material for the cap 21 or two materials of a different softness. The tampon can also consist of cotton wool.

Figure 2:
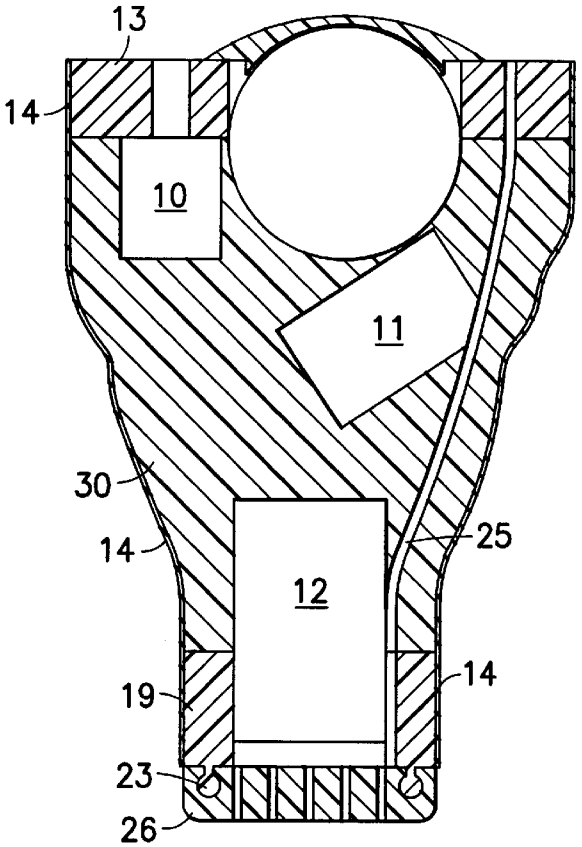
FIG. 2 is a section through the innermost region of the hearing aid according to FIG. 1 in its individualized condition.

FIG. 2 shows a sectional view (same section plane as in FIG. 1) through the innermost part of the hearing aid according to FIG. 1. In this FIG. the hearing aid is shown in its individualized condition, i.e. the hearing aid now has a body 30 surrounded laterally by the membrane 14. Furthermore, the provisional supporting element 18 or the flexible length-limiting element respectively and the positioning tip 20 are removed. The appliance now has a ventilation channel 25 (opened in the cast body by the removal of the provisional supporting element 18 or by a tube for molding the ventilation channel which tube is not removed) running through the appliance in substantially an axial direction and it has an innermost part which has a smaller diameter than the rest of the appliance. Furthermore, the outlet side of the loudspeaker 12 and the outlet of the ventilation channel 25 are covered by a finely perforated loudspeaker cover 26 which comprises positive engaging means similar to the ones on positioning tip 20 by means of which it is fixed to the connecting means 19. This loudspeaker cover 26 protects the outlet side of the loudspeaker 12 and the outlet of the ventilation channel 25 from contamination and blockage with cerumen. In the same way as the positioning tip 20, the loudspeaker cover 26 is removable from the appliance and thus exchangeable when contaminated.

Variations of the hearing aid according to FIGS. 1 and 2 e.g. consist in the positioning tip 20 being only fixed to the provisional supporting element 18, in the absence of a tampon 22, in the positioning tip not being designed as a closed cap but as a tube and in the positioning tip not protruding over the connecting element 15 towards the body.

Figure 4:
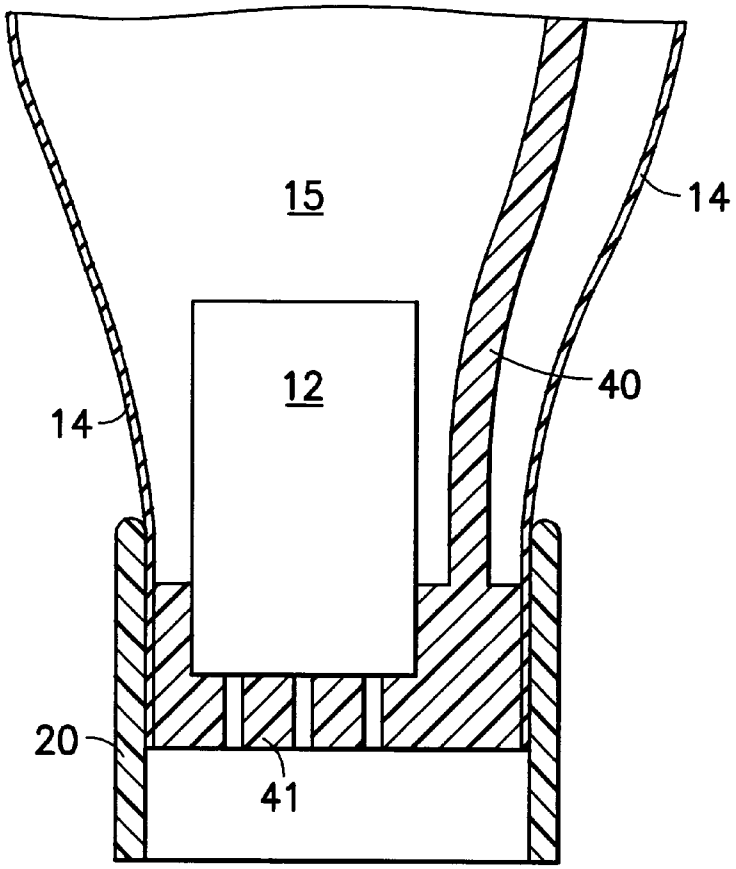
FIGS. 3 and 4, like FIG. 2, show sections through further hearing aids with different positioning tips.
Figure 3:
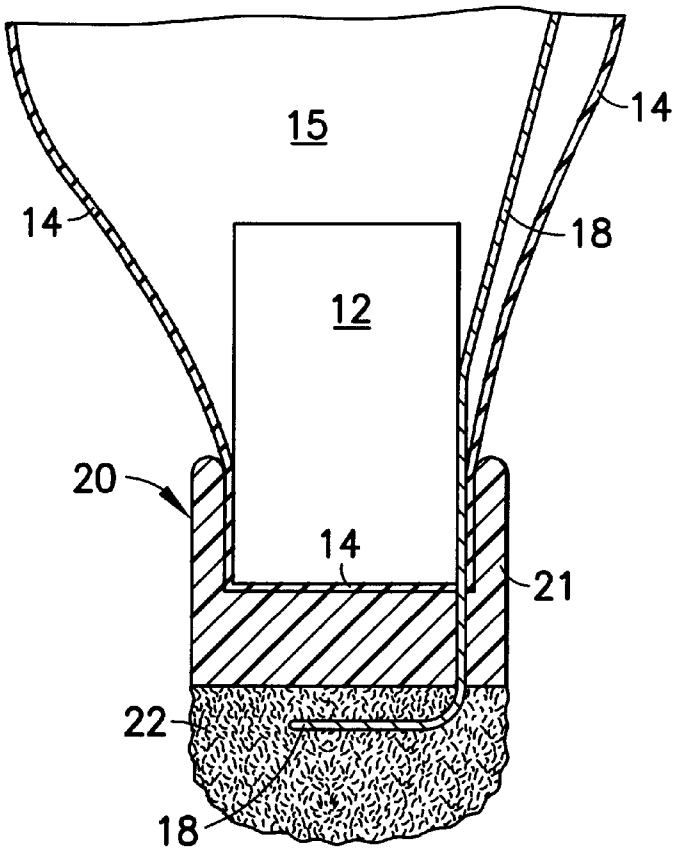

FIGS. 3 and 4 show further embodiments variants of hearing aids with positioning tips, whereby the innermost part of each appliance in its general condition is shown as a section parallel to the axis of the appliance.

FIG. 3 shows a very simple embodiment in which the positioning tip 20, apart from its main function which consists in positioning (centering) the innermost part of the general appliance in the auditory canal also has the function of temporarily fixing the membrane 14 to the loudspeaker 12 and possibly even the function of temporarily positioning the provisional supporting element 18 relative to the loudspeaker.

The positioning tip 20 is again shown as a cap 21. This cap 21 is dimensioned such that it is extended elastically when stuck over the outlet side of the loudspeaker 12, i.e. that it is fixed to the loudspeaker 12 by means of an elastic frictional connection. The membrane 14 is positioned between the loudspeaker 12 and the cap 21, advantageously extending continuously over the outlet-side of the loudspeaker 12 as well as over the provisional supporting element for which possibly a sleeve (not shown) fastened to the loudspeaker 12 is provided. The supporting element 18 may extend through the cap 21 and can act as an additional fastening element for the cap 21 and it may also carry a tampon.

For the simple embodiment of the innermost part of the hearing aid and the positioning tip according to FIG. 3 it is a condition that the casting material used for casting the body in the casting cavity 15 does not only form a sufficiently strong connection with the material of the membrane 14 but also with the outside of the loudspeaker. Only if this condition is fulfilled, it is guaranteed that after removing the positioning tip 20 and the provisional supporting element 18 the individualized appliance has a sufficient stability in the region of its innermost part.

FIG. 4 on the one hand illustrates a positioning tip in the form of a tube and on the other hand it shows that a hearing aid with a permanent (instead of temporary) supporting element can be equipped with a positioning tip also. Hearing aids with permanent supporting elements which are not removed after individualizing are e.g. described in the previously named publication EP-629101. They comprise a so-called skeleton which consists of an outer element (face plate, not shown), an inner element 41 and a middle skeleton element 40 which connects the other two skeleton elements. The simple positioning tip 20 in form of a tube is simply stuck over the inner skeleton element 41 and is fixed to it by means of an elastic frictional connection Obviously, the features of the hearing aids and positioning tips as shown in FIGS. 1 to 4 can also be usefully combined in different manners from the ones shown.

We claim:

1. A hearing aid to be worn completely within the wall of the auditory canal of a patient and reaching a depth in the auditory canal at which contact with the wall causes discomfort, the hearing aid comprising a body produced by casting within the auditory canal, or within a model of said canal, so as to conform to the shape of said canal, said body having a central axis and including an outer face with an opening for allowing a curable casting material to be poured therethrough, an inner face having an outer surface with a diameter smaller than said auditory canal and constituting an innermost end of said hearing aid, and an elastic membrane surrounding and extending between said outer and inner faces, said membrane defining a casting cavity before casting, for receiving the casting material and for conforming to the canal wall shape after casting;

components for enhancing hearing function carried by said body, said components including a receiving device, an amplifier and a loudspeaker;

a positioning tip removably attached to said inner face and including a cap portion surrounding said innermost end of said hearing aid and radially spacing said innermost end from walls of said auditory canal during casting of said body, said positioning tip being removed after casting said body so that, when said hearing aid is placed in the auditory canal, said innermost end is substantially centered in said auditory canal and remains spaced from walls of the canal around the innermost end thereof.

2. A hearing aid according to claim 1 wherein said positioning tip includes an end portion protruding axially beyond said innermost end to space said innermost end from the eardrum of the patient.

3. A hearing aid according to claim 2 wherein said axially protruding end portion comprises a tampon made of a material softer than said cap portion.

4. A hearing aid according to claim 1 wherein said cap portion comprises a tube.

5. A hearing aid according to claim 1 wherein said cap portion comprises positive locking means for engaging said innermost end.

6. A hearing aid according to claim 5 wherein said positive locking means comprises a tongue on one of said cap portion and said innermost end and a mating groove on the other of said cap portion and said innermost end.

7. A hearing aid according to claim 1 wherein said cap portion is connected to said innermost end by elastic frictional engagement.

8. A hearing aid according to claim 1 wherein said body includes a provisional supporting element for spacing said hearing enhancing components, and wherein said positioning tip includes an opening for connection to said provisional supporting element.

9. A hearing aid according to claim 1 wherein said provisional supporting element is fastened to said positioning tip and is removed with said tip.

10. A hearing aid according to claim 1 wherein said body comprises a flexible element for limiting total length of said body during casting, said flexible element being connected to said positioning tip.

11. A hearing aid according to claim 1 wherein said inner face includes said loudspeaker, said hearing aid including a loudspeaker cover attached to said innermost end after removal of said positioning tip.

* * * * *